US010119222B2

(12) United States Patent
Wang

(10) Patent No.: US 10,119,222 B2
(45) Date of Patent: Nov. 6, 2018

(54) COATED IRONING PLATE AND METHOD OF FORMING A COATED IRONING PLATE

(71) Applicant: KONINKLIJKE PHILIPS N.V., Eindhoven (NL)

(72) Inventor: Zheng Wang, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/750,702

(22) PCT Filed: Oct. 28, 2016

(86) PCT No.: PCT/EP2016/076098
§ 371 (c)(1),
(2) Date: Feb. 6, 2018

(87) PCT Pub. No.: WO2017/072306
PCT Pub. Date: May 4, 2017

(65) Prior Publication Data

US 2018/0230641 A1 Aug. 16, 2018

(30) Foreign Application Priority Data

Oct. 29, 2015 (EP) ..... 15192105

(51) Int. Cl.
*D06F 75/38* (2006.01)
*H01B 3/10* (2006.01)
(Continued)

(52) U.S. Cl.
CPC ..... *D06F 75/38* (2013.01); *H01B 3/10* (2013.01); *H01B 3/12* (2013.01); *H01B 3/445* (2013.01); *H05F 3/00* (2013.01)

(58) Field of Classification Search
CPC ..... D06F 75/00; D06F 75/26; D06F 75/38; H01B 3/00; H01B 3/10; H01B 3/12; H01B 3/44; H01B 3/443; H01B 3/445
See application file for complete search history.

(56) References Cited

U.S. PATENT DOCUMENTS 4,078,107 A * 3/1978 Bitterice ..... B32B 17/10018 428/38
4,800,661 A 1/1989 Yamamota
(Continued)

FOREIGN PATENT DOCUMENTS

DE 1952846 A1 4/1971
DE 3617034 A1 4/1987
(Continued)

OTHER PUBLICATIONS http://www.physicsclassroom.com/class/estatics.
http://www.fibraplex.com/staticelectricitywhitesheet.htm.

*Primary Examiner* — Ismael Izaguirre

(57) ABSTRACT

The invention relates to a coated ironing plate comprising an ironing plate (4); and a composite coating (7) applied over the ironing plate (4). The composite coating comprises a dielectric layer (5) over the ironing plate (4) that has a surface resistance more than $10^9$ ohms; and a static dissipative layer (6) for being in contact with a garment or fabric during ironing disposed on the dielectric layer (5) and in direct contact with the ironing plate (4). The static dissipative layer (6) has a surface resistance less than $10^9$ ohms so that the charges generated on the static dissipative layer (6) during ironing are more easily dissipated from the static dissipative layer (6) through the ironing plate (4) compared to the dissipation of charges from the dielectric layer (5) through the ironing plate (4) in the absence of said static dissipative layer (6).

14 Claims, 5 Drawing Sheets

(51) Int. Cl.

| | |
|---|---|
| ***H01B 3/12*** | (2006.01) |
| ***H05F 3/00*** | (2006.01) |
| ***H01B 3/44*** | (2006.01) |
| *H01B 3/00* | (2006.01) |

(56) References Cited

U.S. PATENT DOCUMENTS

| | | | | |
|---|---|---|---|---|
| 5,592,765 | A | 1/1997 | Oomen | |
| 6,579,157 | B1 * | 6/2003 | Gotkis | B24B 21/04 451/286 |
| 2008/0189993 | A1 * | 8/2008 | Cavada | D06F 75/06 38/82 |
| 2008/0290088 | A1 * | 11/2008 | Leboeuf | H05B 3/262 219/764 |
| 2009/0019737 | A1 * | 1/2009 | Moreno Jordana | D06F 75/24 38/93 |
| 2011/0315818 | A1 | 12/2011 | Chao | |
| 2012/0258323 | A1 * | 10/2012 | Brown | B64D 45/02 428/457 |

FOREIGN PATENT DOCUMENTS

| | | | |
|---|---|---|---|
| JP | 08150370 | A | 6/1996 |
| WO | 2009105945 | A1 | 9/2009 |
| WO | WO 2010008279 | A1 * | 1/2010 |
| WO | 2014122022 | A1 | 8/2014 |

* cited by examiner

COATED IRONING PLATE AND METHOD OF FORMING A COATED IRONING PLATE

This application is the U.S. National Phase application under 35 U.S.C. § 371 of International Application No. PCT/EP2016/076098, filed on Oct. 28, 2016, which claims the benefit of International Application No. 15192105.3 filed on Oct. 29, 2015. These Application are hereby incorporated by reference herein.

FIELD OF THE INVENTION

The present invention relates to a coating for an ironing plate and a method of forming a coated ironing plate.

BACKGROUND OF THE INVENTION

Triboelectric (or friction) charging happens when surfaces of two different material touch and separate from each other. The atoms of one material will often have a greater attraction for electrons than the other material (difference in electron affinity). When this happens, one surface will have a negative charge (more electrons) and the other will have a positive charge (fewer electrons).

Triboelectricity is observed when friction occurs between two dielectrics, two semiconductors, or two metals. The substances may be of different chemical compositions or of identical composition but different densities. It is also observed when friction occurs, for example, between a metal and a dielectric, between two identical dielectrics, between liquid dielectrics, or between a liquid dielectric and the surface of a solid. In all cases, both substances are electrified, and their charges are equal in magnitude but opposite in signs.

Static is often a major problem on machinery that processes non-conductive materials. Two simple rules are commonly used to deal with charging problems: the first method is to ground all conductors; the second method is to either remove or control all insulative charge generators.

If the charged object is conductive it should be connected by a wire to an earth ground. This is usually the metal frame of a machine, a cold water pipe, or something similar. Alternatively, static on non-conductive surfaces can be removed by making the surface conductive to ground. Anti-static sprays and additives work this way by attracting moisture from the air and making the surface slightly conductive. There must still be a path to ground or to the oppositely charged surface. Anti-static sprays do wear-off and are sensitive to temperature and humidity levels in the air.

The ironing plate (IP) of an iron appliance usually comprises one or more metal sheets or blocks coated with certain coatings on the side which is contacting the fabric or garment during operation. The IP surface coating may serve to provide aesthetic features, protection from corrosion/mechanical damage, and/or low friction for easy gliding on fabric. Commonly used materials for the coating may include polytetrafluroethylene (PTFE), organic inorganic hybrid polymers, and porcelain enamel. Many coatings are dielectric coatings, contain insulating material or are very poor conductors of electric current. FIG. 1 is a diagram showing a structure of organic-inorganic hybrid polymer. Organic-inorganic hybrid polymers may include silicone and/or other insulative materials. R may represent an organic group such as methy, ethyl, or phenyl.

Ironing is a process whereby the ironing plate surface contacts and rubs the fabric surface continuously and repeatedly. When ironing different types of fabrics, it is unavoidable that triboelectric charging phenomenon happens, since the electron affinity of different types of fabric are not same, while the electron affinity of the ironing plate surface remains the same. If ironing is carried out with a metal ironing plate coated with the dielectric coating, the friction charging happens on the surface (i.e. charges are generated on the dielectric coating), which makes the charges hard to remove or dissipate. The dielectric coating is an insulator so that the charges has no way to release/escape. Further, as the resistivity of the dielectric coating is high, the charging speed is much faster than the releasing speed. FIGS. 2A and 2B show two scenarios of net charge on the surface of a dielectric coating coated metal ironing plate and where the metal plate is grounded by conductors from assembly side. FIG. 2A is a schematic showing a metal ironing plate 1 in which the dielectric coating 2 has a net negative charge while the ironing plate 1 is grounded. FIG. 2B is a schematic showing a metal ironing plate 1 in which the dielectric coating 2 has a net positive charge while the ironing plate 1 is grounded. The metal ironing plate 1 may be grounded by iron body 3 as shown in FIG. 2C.

The net charges on the ironing plate surface are opposite to that on the surface of treated fabric, and the net charges increases adhesion between the ironing plate 1 and the fabric. Consequently, friction forces increases. In such scenario, gliding performance is affected and user may feel that the iron is draggy during the ironing operation. In severe circumstances, the fabric may adhere to the ironing plate surface such that the iron cannot be moved relative to the fabric.

DE3617034 discloses a process for coating pressing irons with an anti-adhesive layer, and a pressing iron.

OBJECT AND SUMMARY OF THE INVENTION

It is an object of the invention to propose a coated ironing plate that avoids or mitigates above-mentioned problems.

The invention is defined by the independent claims. The dependent claims define advantageous embodiments.

According to one aspect of the present invention, a coated ironing plate is provided. The coated ironing plate comprises an ironing plate and a composite coating applied over the ironing plate, wherein the composite coating comprises: a dielectric layer over the ironing plate, the dielectric layer having a surface resistance more than $10^9$ ohms; and a static dissipative layer for being in contact with a garment or fabric during ironing disposed on the dielectric layer and in direct contact with ironing plate, the static dissipative layer having a surface resistance less than $10^9$ ohms so that the charges generated on the static dissipative layer during ironing are more easily dissipated from the static dissipative layer through the ironing plate compared to the dissipation of charges from the dielectric layer through the ironing plate in the absence of said static dissipative layer.

The charges generated on the static dissipative coating is more easily dissipated compared to a dielectric coating or layer. The charges are generated when the static dissipative layer rubs against the garment during the ironing process. The static dissipative coating, which has a lower surface resistance compared to the surface resistance of the dielectric layer, helps dissipate the charges generated. The charges are dissipated to the ironing plate, which is in physical contact with the static dissipative layer.

In contrast, for an ironing plate without the static dissipative layer and with only a dielectric coating or layer, charges are generated on the dielectric layer during the ironing process when the dielectric layer rubs against the garment during the ironing process. The charges are less likely to be dissipated due to the high surface resistance of the dielectric coating or layer.

In a preferred embodiment, the dielectric layer is on the ironing plate. In an alternative embodiment, the dielectric layer and the ironing plate may be separated via one or more intermediate layers. The dielectric layer may be selected from a group consisting of an organic-inorganic hybrid polymer layer, a polytetrafluroethylene (PTFE) layer, and a porcelain enamel layer, and any combination thereof. The dielectric layer may protect the ironing plate and/or help in preventing corrosion of the ironing plate.

In a preferred embodiment, the static dissipative layer comprises one or more suitable metal oxides. The one or more suitable metal oxides may be transparent conductive metal oxides. The one or more suitable metal oxides may be selected from a group consisting of tin oxide, antimony-doped tin oxide, zinc oxide, aluminum-doped zinc oxide, indium tin oxide, indium oxide, cadmium oxide, cadmium tin oxide, and indium-doped cadmium oxide.

An electrical appliance (e.g. an iron) comprising the coated ironing plate may also be provided. The electrical appliance may also include a heater for heating the coated ironing plate. The iron may also include a water tank for storing water and a steam generator for heating the water to generate steam. The iron may further include a pump to pump water from the water tank to the steam generator.

The ironing plate may comprise one of aluminum and stainless steel, i.e. it may be aluminum or stainless steel. The ironing plate may comprise also of other suitable metals, other suitable metal alloys (e.g. aluminum alloys), or any other suitable materials.

The static dissipative layer may be in direct contact with one or more edges of the ironing plate. The ironing plate has one or more edges along its boundary. The static dissipative layer may be physically connected to the one or more edges.

The ironing plate may comprise a steam vent defined by a wall. The ironing plate may have one or more steam vents, which allows passage of steam from the steam generator in the iron to the external environment or garment. The static dissipative layer may be in direct contact with the wall defining the steam vent.

According to yet another aspect of the present invention, a method of forming a coated ironing plate may be provided. The method comprises providing an ironing plate; forming an dielectric layer over the ironing plate, the dielectric layer having a surface resistance more than $10^9$ ohms; forming a static dissipative layer for being in contact with a garment or fabric during ironing on the dielectric layer and in direct contact with ironing plate, the static dissipative layer having a surface resistance less than $10^9$ ohms so that the charges generated on the static dissipative layer during ironing are more easily dissipated from the static dissipative layer through the ironing plate compared to the dissipation of charges from the dielectric layer through the ironing plate in the absence of said static dissipative layer.

Forming the dielectric layer may comprise applying dielectric material over the ironing plate by spray coating.

Forming the static dissipative layer may also comprise applying static dissipative material on the ironing plate uncovered by the dielectric layer. The static dissipative material forms the static dissipative layer.

Forming the static dissipative layer may comprise applying static dissipative material on the dielectric layer and allowing the dissipative material to spread to the ironing plate uncovered by the dielectric layer. The static dissipative material deposited on the dielectric layer may spread over the edges on the dielectric layer onto the uncovered portion of the ironing plate.

BRIEF DESCRIPTION OF THE DRAWINGS

Embodiments of the invention will now be described, by way of example only, with reference to the accompanying drawings in which.

DETAILED DESCRIPTION OF THE EMBODIMENTS

Figure 1:
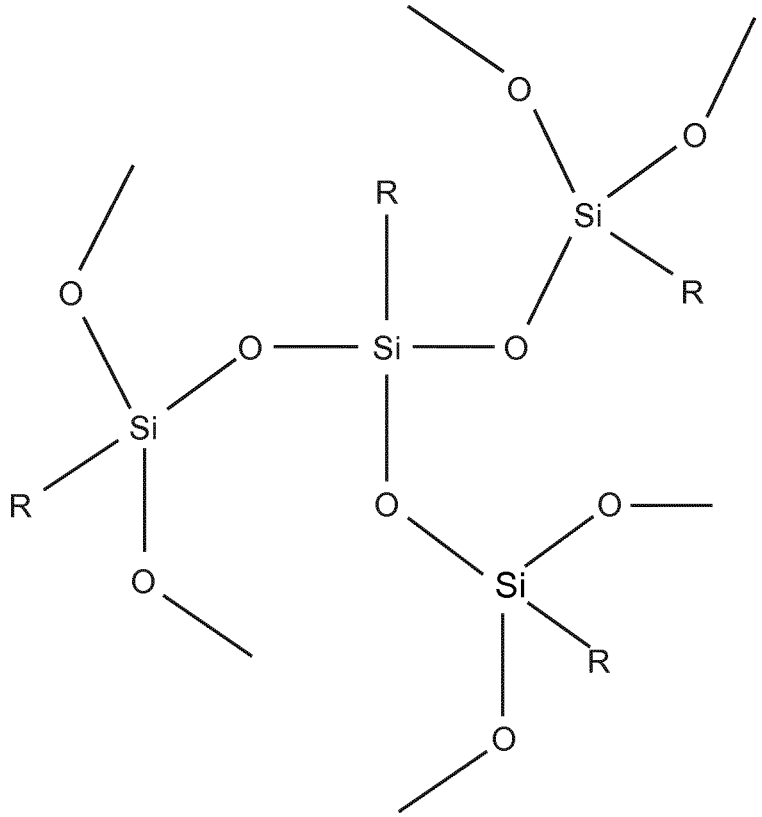
FIG. 1 is a diagram showing a structure of organic-inorganic hybrid polymer.
Figure 2A:
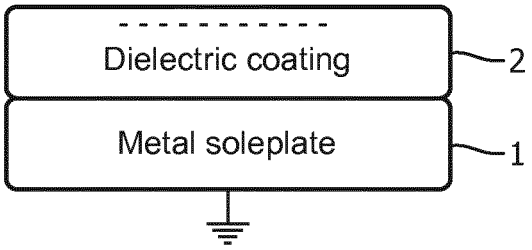
FIG. 2A is a schematic showing a metal ironing plate in which the dielectric coating has a net negative charge while the ironing plate is grounded.
Figure 2B:
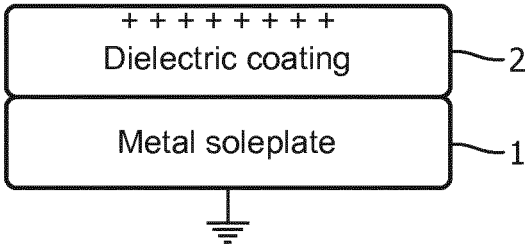
FIG. 2B is a schematic showing a metal ironing plate in which the dielectric coating has a net positive charge while the ironing plate is grounded.
Figure 2C:
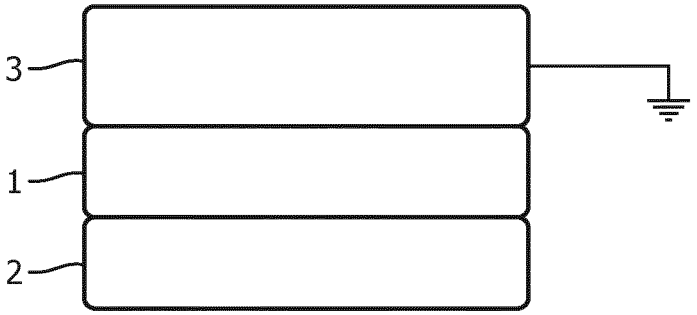
FIG. 2C is a schematic showing metal ironing plate grounded by iron body.
Figure 3:
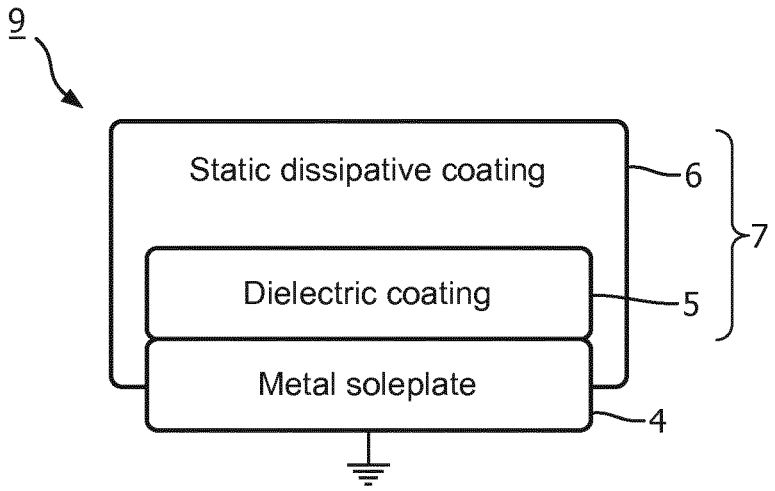
FIG. 3 is a schematic showing the coating 7 for the ironing plate 4 according to one aspect of the present invention.

In one aspect of the present invention, an ironing plate comprising a composite coating may be provided. FIG. 3 is a schematic showing the coating 7 for the ironing plate 4 according to one aspect of the present invention. As shown in FIG. 3, the coating 7 is a composite coating. The (composite) coating 7 comprises a dielectric layer 5 over the ironing plate 4, the dielectric layer 5 having a surface resistance more than $10^9$ ohms. The (composite) coating 7 further comprises a static dissipative layer 6 on the dielectric layer 5 and in direct contact with ironing plate 4, the static dissipative layer 6 having a surface resistance less than $10^9$ ohms.

In other words, the composite coating 7 may be applied over the ironing plate 4. The composite coating 7 comprises a static dissipative layer 6 and a dielectric layer 5. The composite coating 7 may be applied over the ironing plate 4, with the dielectric layer 5 nearer to the ironing plate 4 and the static dissipative layer 6 further from the ironing plate 4. The static dissipative layer 6 is in contact with both the dielectric layer 5 and the ironing plate 4. The static dissipative layer 6 may comprise a first portion in contact with the dielectric layer 5 and a second portion in contact with the ironing plate 4.

As the static dissipative layer 6, which is the outermost layer of the composite coating 7, rubs against the garment or fabric during ironing, charges are induced on the static dissipative layer 6. Due to the low surface resistance of the static dissipative layer 6, the induced charges quickly move from the static dissipative layer 6 to the ironing plate 4. The ironing plate 4 may connected to ground via a suitable means, such as an electrical plug. The charges induced on the static dissipative layer 6 during ironing operation may thus be quickly neutralized via grounding. In various embodiments, the surface resistance of the static dissipative layer 6 may be less than $10^8$ ohms or less than $10^7$ ohms or less than $10^6$ ohms.

The surface resistance may be measured by a surface resistance meter. The surface resistance may be measured by a standard 2-point probe according to test standards ESD STM11.13-2004. According to test standards ESD STM11.13-2004, measurements are made based on well-defined parameters such as size, diameter, distance of the probes and other properties.

The static dissipative layer 6 extends from on the dielectric layer 5 to the portions of the ironing plate 4 that is not covered (i.e. uncovered) by the dielectric layer 5. The static dissipative layer 6 is a continuous layer that covers the dielectric layer 5 and also directly coats at least a portion of the ironing plate 4. FIG. 3 shows the dielectric layer 5 to be on the ironing plate 4. In such circumstances, the dielectric layer 5 is in contact with the ironing plate 4. However, it may also be envisioned that the dielectric layer 5 and the ironing plate 4 to be separated by one or more intermediate layers.

The static dissipative layer 6 may comprise one or more suitable metal oxides. the one or more suitable metal oxides are transparent conductive metal oxides. The one or more suitable metal oxides may be selected from a group consisting of tin oxide, antimony-doped tin oxide, zinc oxide, aluminum-doped zinc oxide, indium tin oxide, indium oxide, cadmium oxide, cadmium tin oxide, and indium-doped cadmium oxide.

The dielectric layer 5 may be selected from a group consisting of an organic-inorganic hybrid polymer layer, a polytetrafluroethylene layer, and a porcelain enamel layer.

The coated ironing plate 9 may comprise an ironing plate 4 and a composite coating 7 as described herein. In other words, the coated ironing plate 9 comprises an ironing plate 4, the dielectric layer 5 over the ironing plate 4 and the static dissipative layer 6 on the dielectric layer 5 and also in direct contact with the ironing plate 4. The composite coating 7 is on an exterior surface of the ironing plate 4, i.e. the surface used for ironing during operation.

An electrical appliance, such as an iron, comprising the coated ironing plate 9 may also be provided. The electrical appliance (e.g. iron) may also include a heater for heating the coated ironing plate 9. The iron may also include a water tank for storing water and a steam generator for heating the water to generate steam. The iron may further include a pump to pump water from the water tank to the steam generator.

The ironing plate 4 may comprise one of aluminum and stainless steel, i.e. it may be aluminum or stainless steel. The ironing plate 4 may comprise also of other suitable metals, other suitable metal alloys (e.g. aluminum alloys) or any other suitable materials.

The static dissipative layer 6 may be in direct contact with one or more edges of the ironing plate 4. The ironing plate has one or more edges along its boundary. The static dissipative layer may be physically connected to the one or more edges.

The ironing plate may comprise a steam vent defined by a wall. The ironing plate may have one or more steam vents, which allows passage of steam from the steam generator in the iron to the external environment or garment. The static dissipative layer may be in direct contact with the wall defining the steam vent.

Figure 4:
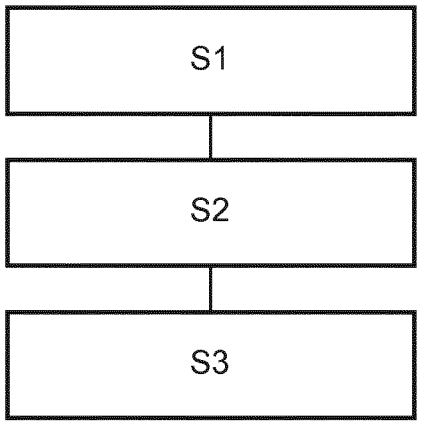
FIG. 4 is a flow chart showing the method according to another aspect of the present invention.

In another aspect of the present invention, a method of forming a coated ironing plate may be provided. FIG. 4 is a flow chart showing the method according to another aspect of the present invention. The method comprises:

in S1, providing an ironing plate 4;

in S2, forming an dielectric layer 5 over the ironing plate 4, the dielectric layer 5 having a surface resistance more than $10^9$ ohms; and in S3, forming a static dissipative layer 6 on the dielectric layer 5 and in direct contact with ironing plate 4, the static dissipative layer 6 having a surface resistance less than $10^9$ ohms.

The dielectric layer 5 may be formed on or over the ironing plate 4. The static dissipative layer 6 is then formed on the dielectric layer 5, with the static dissipative layer 6 in contact with the dielectric layer 5 and the ironing plate 4. The dielectric layer 5 has a surface resistance of more than $10^9$ ohms.

Figure 5A:
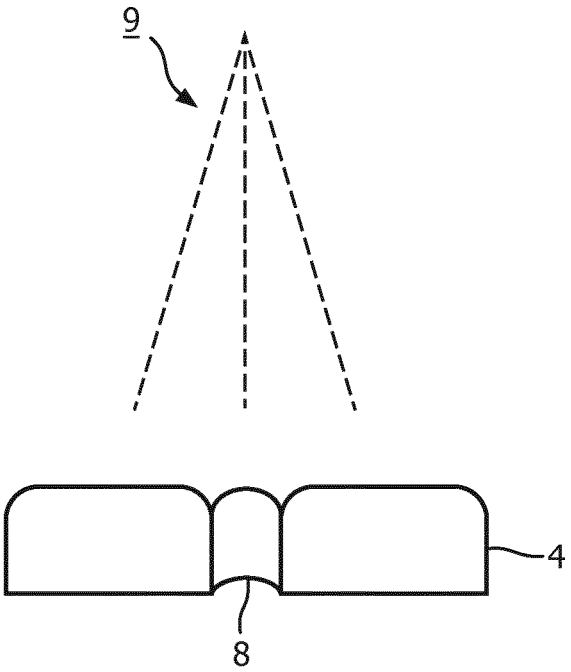
FIG. 5A is a schematic showing the ironing plate 4 undergoing the spray coating process according to one embodiment.
Figure 5B:
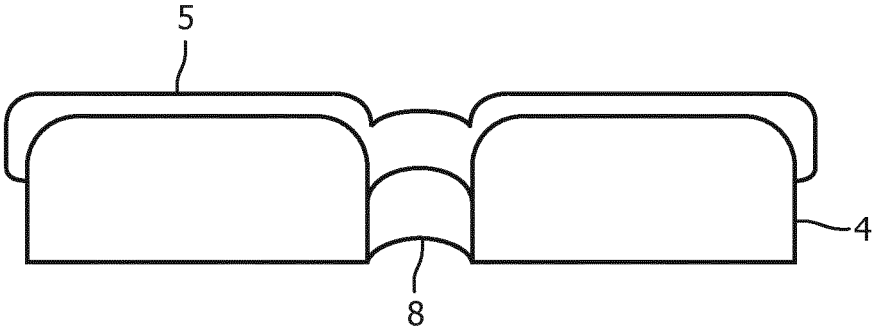
FIG. 5B is a schematic showing the dielectric layer 5 formed on the ironing plate 4 according to one embodiment.

Forming the dielectric layer 5 comprises applying dielectric material over the ironing plate 4 by spray coating. The deposited dielectric material forms the dielectric layer 5. FIG. 5A is a schematic showing the ironing plate 4 undergoing the spray coating process according to one embodiment. The spray coating may applied by a spray coat nozzle or dispenser 9. The ironing plate 4 may have one or more steam vents 8. FIG. 5B is a schematic showing the dielectric layer 5 formed on the ironing plate 4 according to one embodiment. The dielectric layer 5 does not fully cover or coat the ironing plate 4. For instance, portions of the wall defining steam vent 8 and edges of the ironing plate 4 is not covered or not coated by the dielectric layer 5.

Static dissipative material (e.g. in the form of liquid lacquer) may then be applied, e.g. via spray coating, on the ironing plate 4 that is not covered (i.e. uncovered) by the dielectric layer 5. The static dissipative material may refer to a precursor material that (eventually) forms the material of the static dissipative layer 6. The static dissipative layer 6 may be formed from the precursor material through a suitable method, such as the sol-gel method. The precursor material may be heated to form the static dissipative layer 6, for instance at temperatures above 250° C.

Figure 5C:
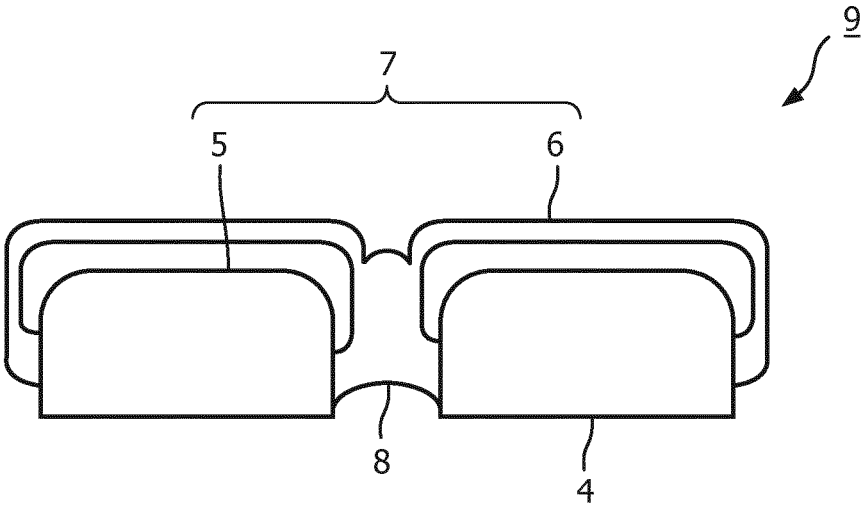
FIG. 5C is a schematic showing the static dissipative layer 6 formed on the dielectric layer 5 according to one embodiment.

The static dissipative material may be applied on the dielectric layer 5. The static dissipative material is then allowed to spread to the ironing plate 4 uncovered (not covered) or not coated by the dielectric layer 5. The static dissipative layer 6 formed by the deposited static dissipative material may directly connect with the metal surface of the ironing plate 4 through edge of the ironing plate 4 or the wall defining steam vent 8. The grounding pathway for dissipation of surface charges to be induced on the static dissipative layer 6 during ironing is therefore established by this method. FIG. 5C is a schematic showing the static dissipative layer 6 formed on the dielectric layer 5 according to one embodiment.

Figure 5D:
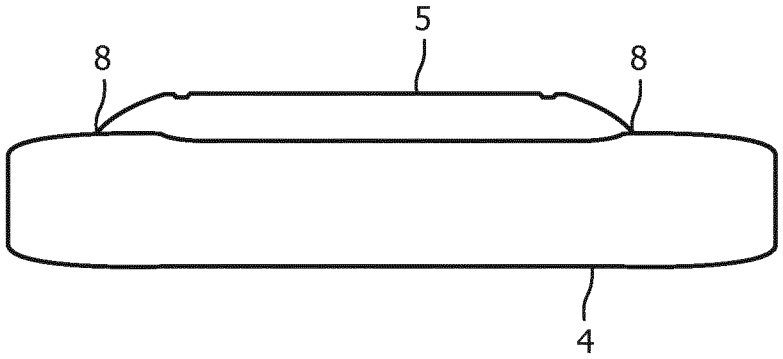
FIG. 5D is a schematic showing coating edge 8 of the dielectric layer 5 according to one embodiment.

The spreading of the dissipative material to the uncovered portions of the ironing plate 4 may be achieved by surface tension driven wetting. The deposited dissipative material or lacquer on the coating edge of the dielectric layer 5 may contact with metal surface of the ironing plate 4 and deposited dissipative material or lacquer may spread further onto the metal surface area of the ironing plate 4 driven by surface energy of the metal surface. FIG. 5D is a schematic showing coating edge 8 of the dielectric layer 5 according to one embodiment.

Alternatively, the static dissipative material or lacquer may be directly applied to the uncovered portions of the ironing plate, such as portions of the wall defining steam vent 8 and edges of the ironing plate 4. The lacquer may be directly shot onto the uncovered matal surface. Generally, any direct connection or contact of the static dissipative layer 6 and the ironing plate 4 may be able to establish the grounding pathway.

Tin oxide (SnO), antimony doped tin oxide (ATO), zinc oxide (ZnO), and aluminium-doped zinc oxide (AZO) may be applied by sol gel coating method to form the static dissipative layer 6. These materials form the static dissipative layer 6 with surface resistance less than $10^6$ ohm. The resistance from any point on the top surface of the coated ironing plate to the earth pin of the iron electrical plug is about $10^6$ ohms and thus the surface is effectively grounded. Transparent conductive coating (e.g. antimony doped tin oxide) may be preferred since it has no impact on the appearance of the underlying dielectric layers. Organic inorganic hybrid coating has high flexibility in forming aesthetic design or features of the ironing plate.

The tin oxide, or antimony doped tin oxide, or titanium oxide layer may be applied by a sol-gel coating process.

For instance, in the case of tin oxude, the lacquer may be tin chloride salt dissolved in a solvent. The lacquer may be sprayed on the ironing plate (which is already coated with the dielectric layer) then cured in oven at about 300° C. for 1 hr to form a static dissipative layer comprising tin oxide.

In the case of antimony doped tin oxide, the lacquer is a mixture of antimony chloride and tin chloride salt dissolved in solvent. The lacquer may be sprayed on the ironing plate (which is already coated with the dielectric layer) then cured in oven at about 300° C. for 1 hr to form a static dissipative layer comprising antimony doped tin oxide.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the scope of the technique approaches of the present invention, which will also fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A coated ironing plate comprising:

an ironing plate; and a composite coating applied over the ironing plate, wherein the composite coating comprises:

a dielectric layer over the ironing plate, the dielectric layer having a surface resistance more than $10^9$ ohms; and a static dissipative layer for being in contact with a garment or fabric during ironing disposed on the dielectric layer and in direct contact with the ironing plate, the static dissipative layer having a surface resistance less than $10^9$ ohms so that the charges generated on the static dissipative layer during ironing are more easily dissipated from the static dissipative layer through the ironing plate compared to the dissipation of charges from the dielectric layer through the ironing plate in the absence of said static dissipative.

2. The coated ironing plate according to claim 1, wherein the dielectric layer is on the ironing plate.

3. The coated ironing plate according to claim 1, wherein the dielectric layer is selected from a group consisting of an organic-inorganic hybrid polymer layer, a polytetrafluroethylene layer, a porcelain enamel layer, and any combination thereof.

4. The coated ironing plate according to claim 1, wherein the static dissipative layer comprises one or more suitable metal oxides.

5. The coated ironing plate according to claim 4, wherein the one or more suitable metal oxides are transparent conductive metal oxides.

6. The coated ironing plate according to claim 4, wherein the one or more suitable metal oxides are selected from a group consisting of tin oxide, antimony-doped tin oxide, zinc oxide, aluminum-doped zinc oxide, indium tin oxide, indium oxide, cadmium oxide, cadmium tin oxide, and indium-doped cadmium oxide.

7. The coated ironing plate according to claim 1, wherein the ironing plate comprises one of aluminum and stainless steel.

8. The coated ironing plate according to claim 1, wherein the static dissipative layer is in direct contact with one or more edges of the ironing plate.

9. The coated ironing plate according to claim 1, wherein:

the ironing plate comprises a steam vent defined by a wall; and the static dissipative layer is in direct contact with the wall defining the steam vent.

10. An electrical appliance for treating garment, the electrical appliance comprising a coated ironing plate according to claim 1.

11. A method of forming a coated ironing plate, said method comprising:

providing an ironing plate;

forming an dielectric layer over the ironing plate, the dielectric layer having a surface resistance more than $10^9$ ohms; and forming a static dissipative layer for being in contact with a garment or fabric during ironing on the dielectric layer and in direct contact with the ironing plate, the static dissipative layer having a surface resistance less than $10^9$ ohms so that the charges generated on the static dissipative layer during ironing are more easily dissipated from the static dissipative layer through the ironing plate compared to the dissipation of charges from the dielectric layer through the ironing plate in the absence of said static dissipative layer.

12. The method of forming the coated ironing plate according to claim 11, wherein forming the dielectric layer comprises applying dielectric material over the ironing plate by spray coating.

13. The method of forming the coated ironing plate according to claim 11, wherein forming the static dissipative layer comprises applying static dissipative material on the ironing plate uncovered by the dielectric layer.

14. The method of forming the coated iron plate according to claim 11, wherein forming the static dissipative layer comprises applying static dissipative material on the dielectric layer and allowing the dissipative material to spread to the ironing plate uncovered by the dielectric layer.

* * * * *